US007464746B2

(12) United States Patent
Edwards

(10) Patent No.: US 7,464,746 B2
(45) Date of Patent: Dec. 16, 2008

(54) METHOD OF CASTING THIN CAST STRIP

(75) Inventor: Jim Edwards, Lafayette, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/463,399

(22) Filed: Aug. 9, 2006

(65) Prior Publication Data

US 2008/0035302 A1 Feb. 14, 2008

(51) Int. Cl.
*B22D 11/06* (2006.01)

(52) U.S. Cl. ..... 164/480; 164/428

(58) Field of Classification Search ..... 164/480, 164/428

See application file for complete search history.

(56) References Cited

U.S. PATENT DOCUMENTS

| | | | |
|---|---|---|---|
| 4,784,209 | A | 11/1988 | Hlinka et al. |
| 5,052,467 | A | 10/1991 | Tanaka et al. |
| 5,706,882 | A | 1/1998 | Fellus |
| 6,193,818 | B1 | 2/2001 | Legresy et al. |
| 6,536,506 | B2 | 3/2003 | Nikolovsky |
| 2001/0052408 | A1 | 12/2001 | Nikolovski |
| 2003/0164229 | A1 | 9/2003 | Nikolovski |
| 2005/0205233 | A1 | 9/2005 | Hohenbichler |
| 2005/0211412 | A1 | 9/2005 | Hohenbichler |

FOREIGN PATENT DOCUMENTS

| | | |
|---|---|---|
| WO | 01/96047 | 12/2001 |

OTHER PUBLICATIONS

International Type Search Report for AU 2006/905575.
PCT/AU2007/001046 International Search Report.
PCT/AU2007/001046 Written Opinion.

*Primary Examiner*—Kuang Lin
(74) *Attorney, Agent, or Firm*—Hahn Loeser & Parks LLP

(57) ABSTRACT

Twin roll casters for casting thin steel strip comprise cooled casting rolls mounted on carriers. One roll is fixed and the other is moveable laterally and biased toward the other roll by carrier drive units acting on the moveable roll carriers. A casting pool of molten steel is supported on the rolls which are rotated to produce a solidified steel strip delivered downwardly from the nip therebetween. A gap is regulated between the rolls such that unsolidified molten metal passes through the nip between the solidified shells of the forming strip and solidifies below the nip. The carrier drive units are effective to apply to the biased roll substantially intermediate biasing forces such that the roll separation force at the casting rolls is regulated to a value between 2 and 4.5 Newtons per millimeter.

8 Claims, 9 Drawing Sheets

METHOD OF CASTING THIN CAST STRIP

BACKGROUND OF THE INVENTION

In the continuous casting method of manufacturing steel, molten metal is cast directly into thin strip by a casting machine apparatus, the shape of the strip is determined by the mold of the casting machine apparatus. The strip may be further subjected to cooling and processing upon exit from the casting rolls.

In the twin roll caster, molten metal is introduced between a pair of counter-rotated laterally positioned casting rolls which are internally cooled so that metal shells solidify on the moving casting roll surfaces, and are brought together at the nip between the casting rolls to produce a thin cast strip product, delivered downwardly from the nip between the casting rolls. The term "nip" is used herein to refer to the general region at which the casting rolls are closest together. The molten metal may be poured from a ladle through a metal delivery system comprised of a tundish in a core nozzle located above the nip, to form a casting pool of molten metal supported on the casting surfaces of the rolls above the nip and extending along the length of the nip. This casting pool is usually confined between refractory side plates or dams held in sliding engagement with the end surfaces of the casting rolls so as to restrain the two ends of the casting pool.

The setting up of an adjustment of the casting rolls in a twin roll caster is a significant feature. The casting roll must be accurately set to fully define an appropriate separation of the casting rolls at the nip, generally of the order of a few millimeters or less. There must be some device for allowing at least one of the casting rolls to move outwardly against the biasing force to accommodate fluctuations in strip thickness, particularly during start-up.

Usually, one of the casting rolls is rotatably mounted in a fixed journal, and the other roll is rotatably mounted on supports that can move against the action of biasing force to enable the rolls to move laterally to accommodate fluctuations in casting roll separation and strip thickness. The biasing force may be supplied by helical compression springs, or alternatively, by a pair of cylindrical pressure fluid units. A strip caster with spring biasing of the lateral movement of the casting rolls is disclosed in U.S. Pat. No. 6,167,943 to Fish et a1.

Previously, we have proposed that the biasing force be substantially the same or slightly more than that required to balance the ferrostatic pressure of the casting pool and the mechanical friction involved in the moving of the casting rolls biasing toward each other such that a substantially constant gap is maintained between the rolls at the nips sufficient to provide separation between the solidified shells at the nip. This has been described in U.S. Pat. Nos. 6,536,506 and 6,988,530 issued on Mar. 25, 2003 and Jan. 24, 2006, respectively, in this prior casting roll method, the roll separation force is between 0 and 1.25 kN biasing force on each chock at the end of each casting roll. Or stated another way, a roll separation force is produced that is between about 0 to 1.85 N/mm across the casting roll surface. We now have found, surprisingly, that a slightly larger roll separation force is more effective, particularly in controlling the quality of the strip in connection with the invention described in Application Ser. No. 11/467,652, and in allowing strip thickness to be further reduced during a casting campaign, if desired.

It has also been proposed to have a roll separation force at the casting rolls between 5 and 150 N/mm. See U.S. 2005/0205233 A1, Sep. 22, 2005 and US 2005/0211412, Sep. 29, 2005. This roll separation force is not believed to allow for the type of control to provide quality thin cast strip as the present invention facilitates.

SUMMARY OF THE INVENTION

A method of casting metal strip is disclosed that comprises:

a) assembling a pair of cooled casting rolls having a nip between them and confining closures adjacent the ends of the nip;

b) introducing metal between the pair of casting rolls to form a casting pool between the rolls with the closures confining the pool adjacent the ends with the nip;

c) rotating the rolls such that shells of metal solidify from the casting pool to form on the casting rolls and are brought together at the nip to form a solidified strip delivered downwardly from the nip;

d) applying a force to at least one of the pair of casting rolls such that a roll separation force at the casting rolls is regulated to a value between 2 and 4.5 Newtons per millimeter; and e) forming a thin metal strip delivered downwardly from the nip of the casting rolls.

We have found that the gauge variations in cast strip can be alleviated by having a roll separation force that is higher than that required to balance the ferrostatic pool pressure and to overcome the mechanical friction involved in moving the rolls. In particular, a roll separation force in the range of between 2 and 4.5 Newtons per millimeter is particularly effective in controlling the quality of the strip in connection with the invention described in Application Ser. No. 11/467,652. Such a range of roll separation forces also allows the thickness of the cast strip to be further reduced during a casting campaign by further grinding in the shoulders of the side dams and reducing the gap.

In at least one aspect, an embodiment of the present invention combines the features of applying a constant casting roll separation force and establishing a roll gap that is allowed to vary and that will enable molten metal to be passed through the nip to further reduce strip defects. Embodiments of the present invention may also allow for roll eccentricity compensation.

According to an embodiment of the present invention, there is provided a method of casting metal strip including introducing molten metal between a pair of cooled casting rolls forming a nip between them to form a casting pool of molten metal supported on the rolls, confining the pool at the ends of the nip by pool confining closures and rotating the rolls such that the shells of metal solidify from the casting pool onto the casting rolls and are brought close together at the nip to produce a solidified strip delivered downwardly from the nip. The casting rolls are biased bodily toward each other, in at least some embodiments, under a varying gap between them at the nip. The gap is such as to maintain separation between the solidified shells at the nip so that molten metal passes in the space between them through the nip and is, at least in part, subsequently solidified between the solidified shells within the strip below the nip.

The molten metal may be molten steel and the method may produce solidified steel strip at a casting speed of at least 30 meters/minute. The casting speed may be at least 60 meters/minute. The separation space between the solidified shells at the nip may be in the range of 0 to 50 microns or more, in accordance with various embodiments of the present invention.

The biasing force is somewhat higher than the minimum force required to balance the ferrostatic pressure of the casting pool and to overcome the mechanical friction involved in moving the biased roll. For 500 mm diameter rolls being 1350 mm wide, and a 175 mm pool, putting aside mechanical friction which should be kept small, the ferrostatic force of the molten casting pool will be about 0.75 kN. In accordance with an embodiment of the present invention, the roll separation force, which is the net force exerted on the strip, is regulated to a range of about 2 to 4.5 Newtons per millimiter.

At least one casting roll may be mounted on a pair of moveable roll supports or carriers moveable to provide the bodily movement of at least one of the casting rolls relative to the other casting roll, and the biasing force may be applied to the roll supports by a pair of biasing units (carrier drive units or mechanisms). Each biasing unit may include a thrust generator acting between a thrust transmission structure connected to the respective roll support, and a thrust reaction structure generating (exerting) a thrust on the roll support dependent on the spacing between the thrust reaction structure and the thrust transmission structure. The thrust generator may comprise a compression spring or pressure fluid cylinder unit, in accordance with an embodiment of the present invention.

These and other advantages and novel features of the present invention, as well as details of an illustrated embodiment thereof, will be more fully understood from the following description and drawings.

DETAILED DESCRIPTION OF THE INVENTION

Figure 1:
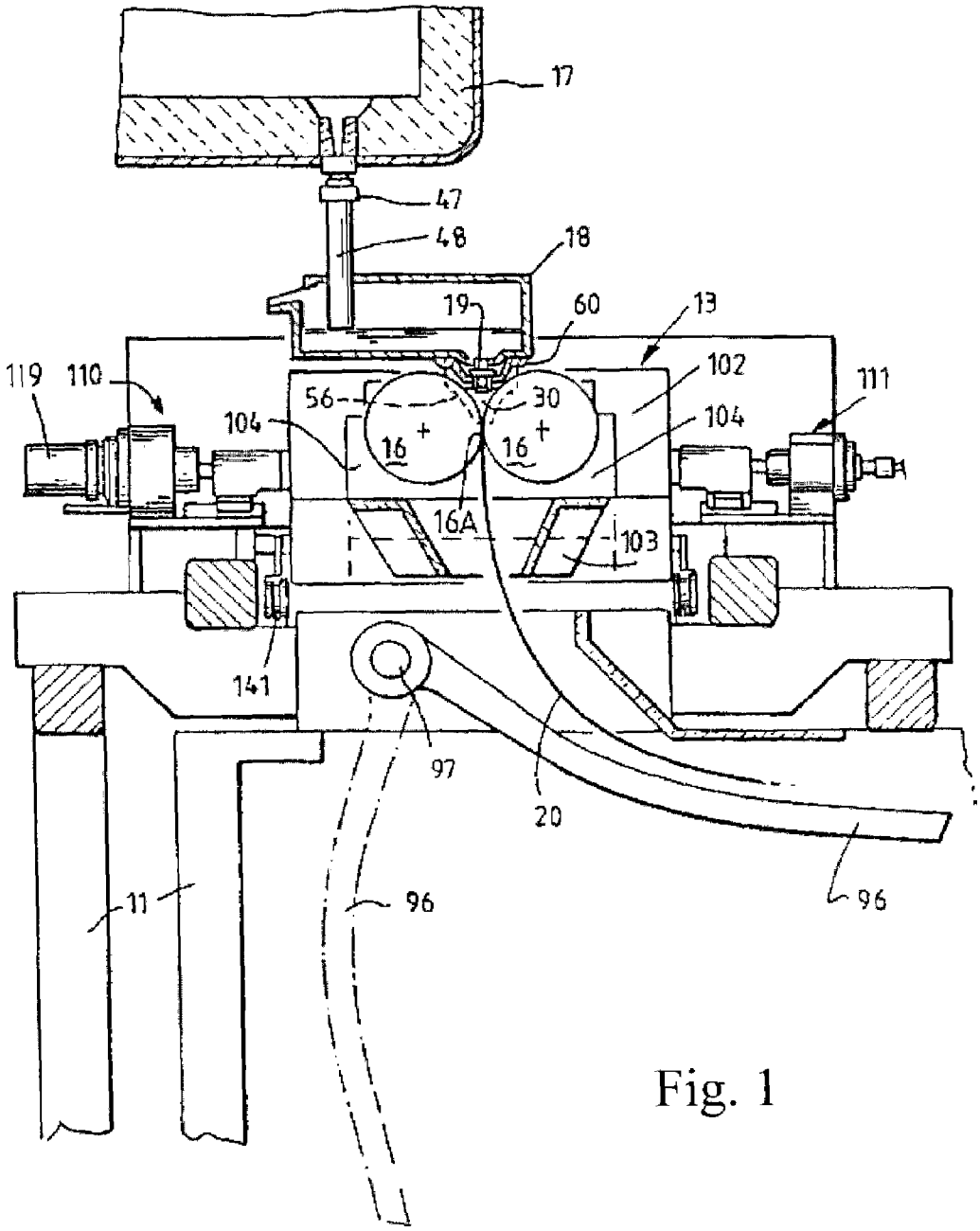
FIG. 1 is a vertical cross section through a strip caster constructed in accordance with an embodiment of the present invention.
Figure 2:
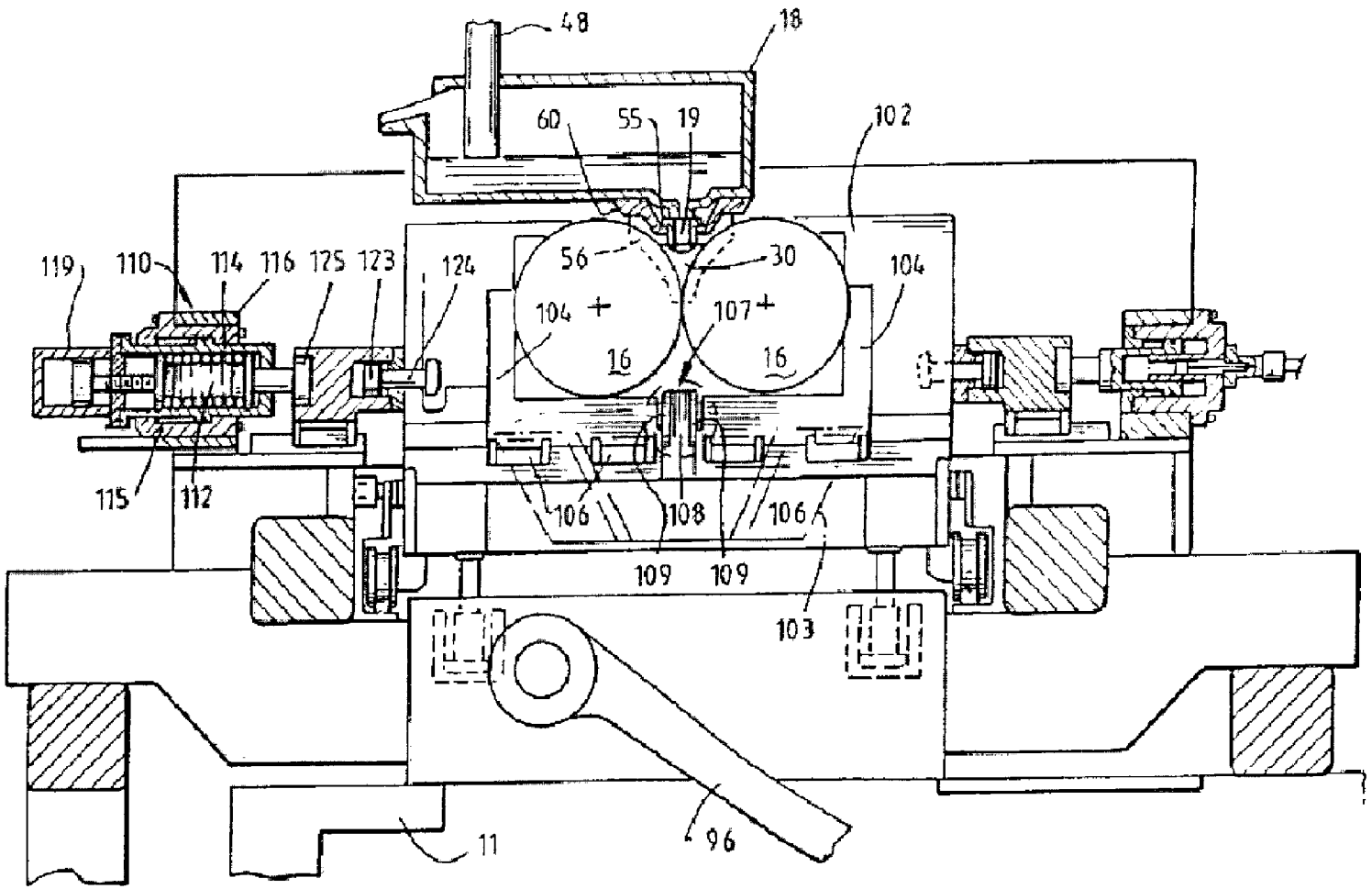
FIG. 2 is an enlargement of part of FIG. 1 illustrating particular components of the caster.
Figure 3:
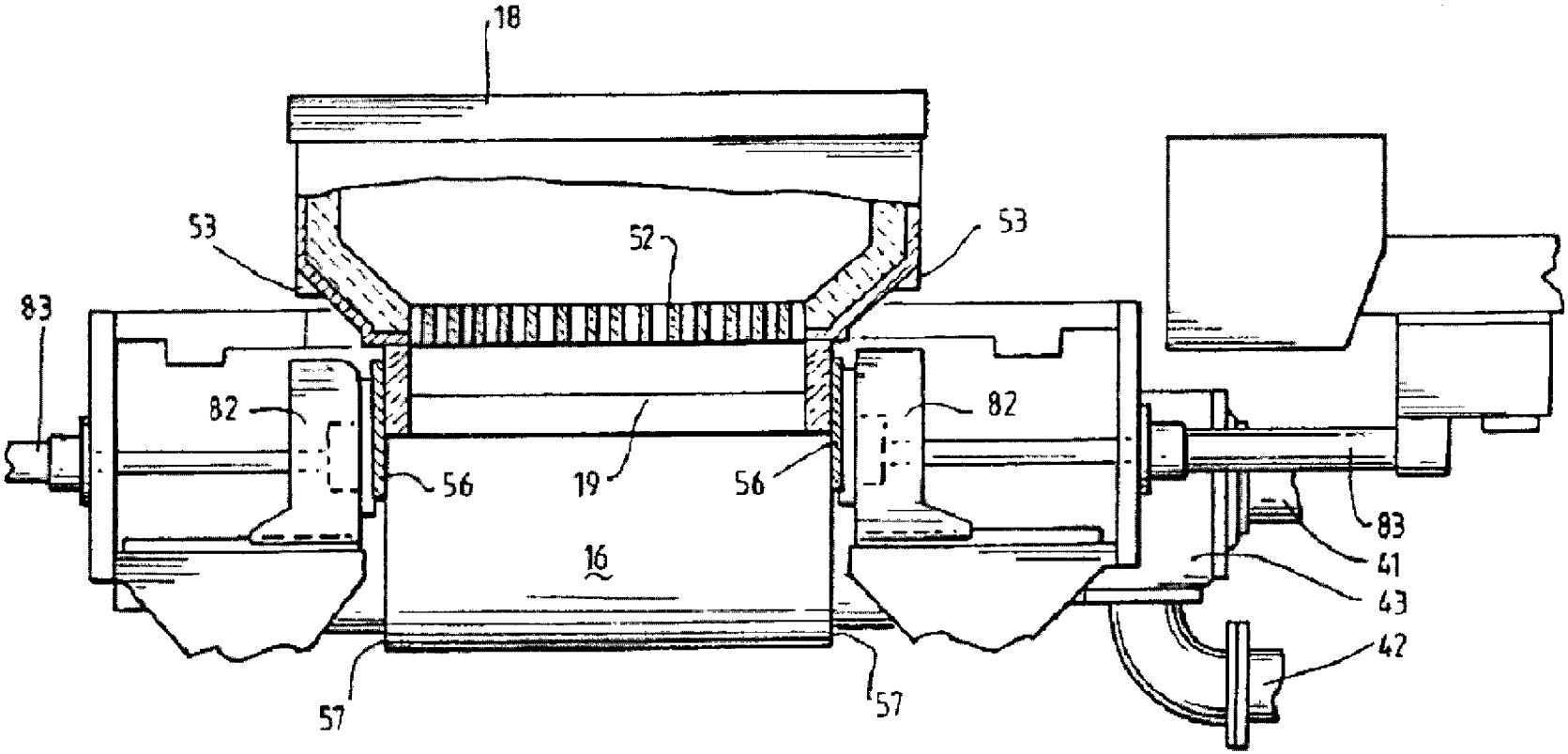
FIG. 3 is a longitudinal cross section through particular parts of the caster, in accordance with an embodiment of the present invention.

The illustrated caster comprises a main machine frame 11 which stands up from the factory floor (not shown) and supports a casting roll module in the form of a cassette 13 which can be moved into an operative position in the caster as a unit but can readily be removed when the rolls are to be replaced. Cassette 13 carries a pair of parallel cooled casting rolls 16 having a nip 16A between them, to which molten metal is supplied by a metal supply system during a casting operation from a ladle (not shown) via a tundish 17, distributor 18 and delivery nozzle 19 to create a casting pool 30. Casting rolls 16 are water cooled so that solidified shells form onto the moving roll surfaces and are brought together at the nip 16A between them to produce a solidified strip product 20 at the roll outlet. This product may be fed to a standard coiler.

Casting rolls 16 are counter-rotated through drive shafts 41 from an electric motor and transmission mounted on the main machine frame. The drive shaft can be disconnected from the transmission when the cassette is to be removed. Rolls 16 have copper peripheral walls formed with a series of longitudinally extending and circumferentially spaced water cooling passages supplied with cooling water through the roll ends from water supply ducts in the roll drive shafts 41 of the roll drive mechanism which are connected to water supply hoses 42 through rotary glands 43. The roll may typically be about 500 mm in diameter and up to 2000 mm long in order to produce strip product approximately the width of the rolls.

The ladle is of entirely conventional construction and is supported on a rotating turret whence it can be brought into position over the tundish 17 to fill the tundish. The tundish may be fitted with a sliding gate valve 47 actuable by a servo cylinder to allow molten metal to flow from the tundish 17 through the valve 47 and refractory shroud 48 into the distributor 18.

The distributor 18 is formed as a wide dish made of a refractory material such as, for example, magnesium oxide (MgO). One side of the distributor 18 receives molten metal from the tundish 17 and the other side of the distributor 18 is provided with a series of longitudinally spaced metal outlet openings 52. The lower part of the distributor 18 carries mounting brackets 53 for mounting the distributor 18 onto the main canter frame 11 when the cassette 13 is installed in its operative position.

Delivery nozzle 19 is formed as an elongate body made of a refractory material such as, for example, alumina graphite. Its lower part is tapered so as to converge inwardly and downwardly so that it can project into the nip 16A between casting rolls 16. Its upper part is formed with outwardly projecting side flanges 55 that locate on a mounting bracket 60 which forms part of the main frame 11.

Nozzle 19 may have a series of horizontally spaced generally vertically extending flow passages to produce a suitably low velocity discharge of molten metal throughout the width of the rolls and to deliver the molten metal into the nip 16A between the rolls without direct impingement on the roll surfaces at which initial solidification occurs. Alternatively, the nozzle 19 may have a single continuous slot outlet to deliver a low velocity curtain of molten metal directly into the nip 16A between the casting rolls 16 and/or it may be immersed in the molten metal pool between the casting rolls 16.

The pool is confined at the ends of the rolls by a pair of side closure plates or dams 56 that are held against stepped ends 57 to the rolls when the roll cassette is in its operative position to confine the molten metal in the casting pool against outflow adjacent the ends of the nip. Side closure plates 56 are made of a strong refractory material and have scalloped side edges to match the curvature of the stepped ends of the rolls. The side closure plates 56 can be mounted in plate holders 82 which are moveable by actuation of a pair of hydraulic cylinder units 83 to bring the side plates into engagement with the stepped ends of the casting rolls to form end closures for the molten pool of metal formed on the casting rolls during a casting operation. Side closure plates 56 are adjacent the ends of the nip 16A, and confine the casting pool formed between the casting rolls 16.

During a casting operation, the sliding gate valve 47 is actuated to allow molten metal to pour from the tundish 17 to the distributor 18 and through the metal delivery nozzle 19 whence it flows onto the casting rolls to form the casting pool with confinement of the side closure plates 56. The head end of the strip product 20 is guided by actuation of an apron table 96 to a pinch roll and thence to a coiling station (not shown). Apron table 96 hangs from pivot mountings 97 on the main frame and can be swung toward the pinch roll by actuation of a hydraulic cylinder unit (not shown) after the clean head end has been formed.

The removable roll cassette 13 is constructed so that the casting rolls 16 can be set up and the gap of the nip 16A between them adjusted before the cassette is installed in position in the caster. The gap between the casting rolls at this point in assembly generally should be as small as possible without the casting rolls touching each other. More-over, when the cassette 13 is installed, two pairs of roll biasing units 110 and 111 mounted on the main machine frame 11 can be rapidly connected to roll supports on the cassette 13 to provide biasing forces resisting separation of the rolls.

Figure 4:
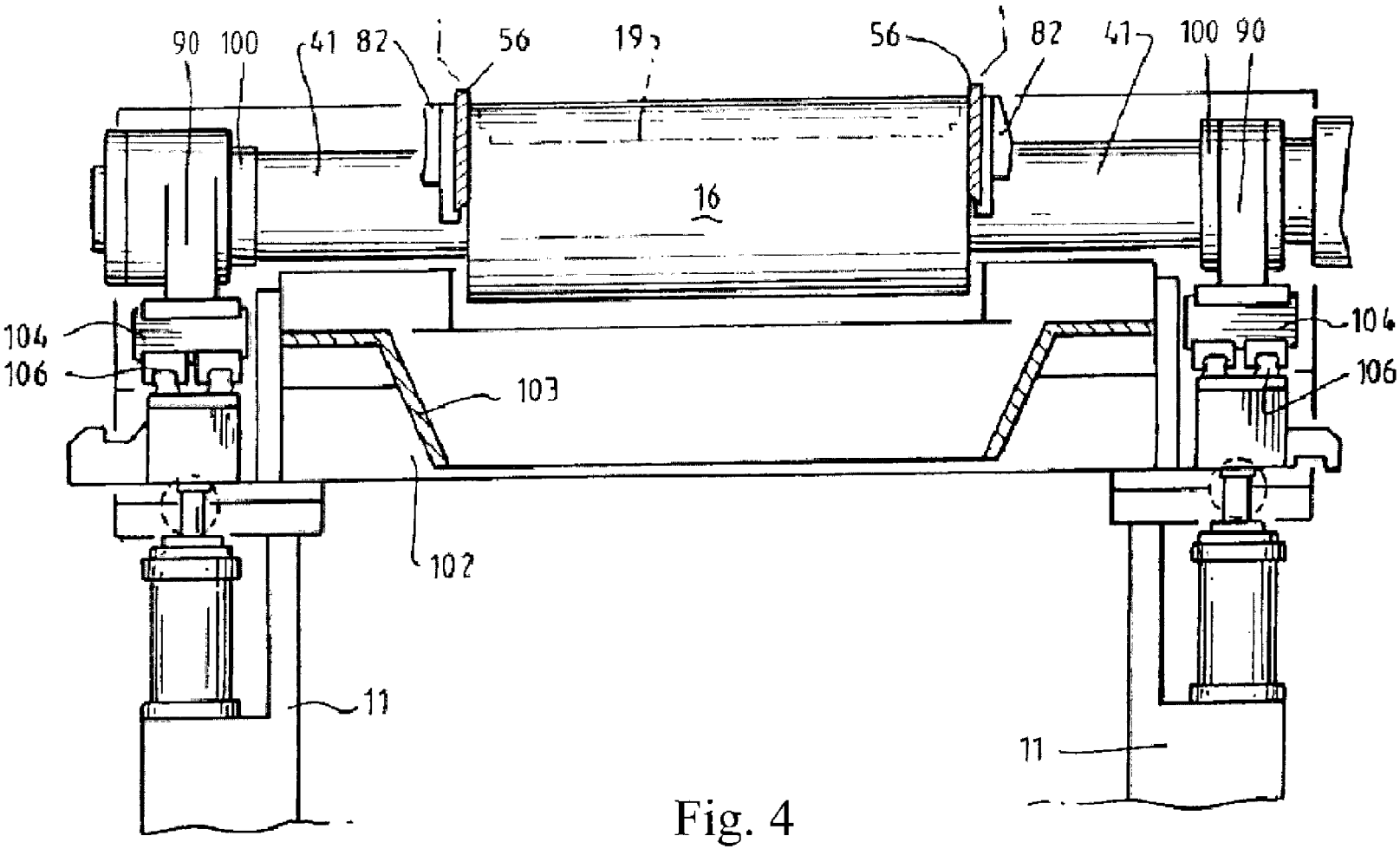
FIG. 4 is an elevation view of the caster.
Figure 5:
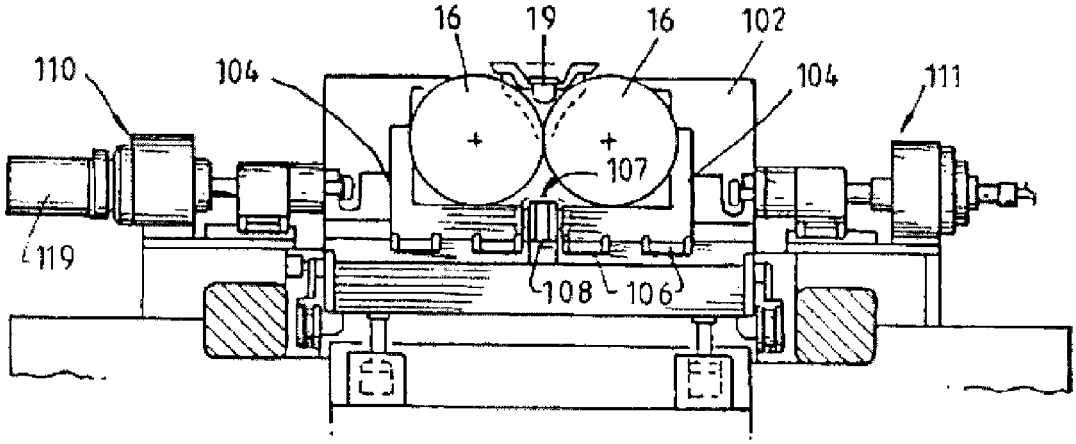
FIGS. 5-7 show the caster in varying conditions during casting and during removal of the roll module from the caster.
Figure 6:
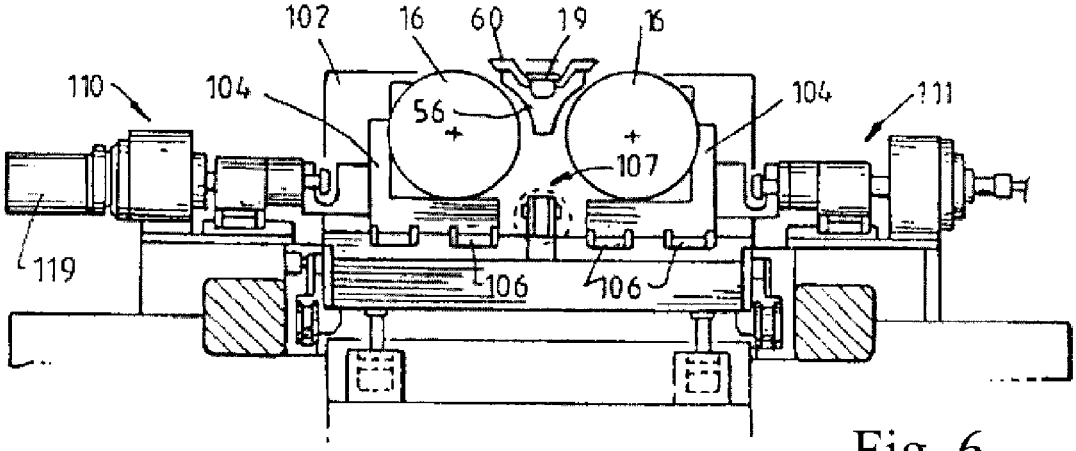
Figure 7:
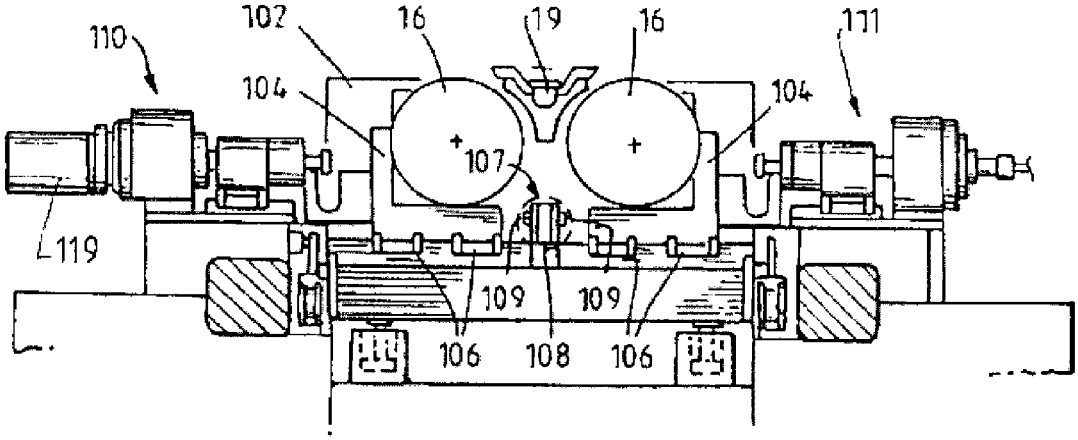

Roll cassette 13 comprises a large frame 102 that carries the casting rolls 16 and upper part 103 of the refractory enclosure for enclosing the cast strip below the nip 16A. Rolls 16 are mounted on roll supports 104 that comprise a pair of roll end support structure 90 (FIG. 4) carrying roll end bearings 100 by which the rolls are mounted for rotation about their longitudinal axis in parallel relationship with one another. The two pairs of roll supports 104 are mounted on the roll cassette frame 102 by means of linear bearings 106 whereby they can slide laterally of the cassette frame to provide for bodily movement of the rolls toward and away from one another, thus permitting separation and closing movement between the two parallel casting rolls 16.

Roll cassette frame 102 also carries two adjustable stop means 107 disposed beneath the casting rolls 16 about a central vertical plane between the rolls and located between the two pairs of roll supports 104 so as to server as stops limiting inward movement of the two roll supports 104 thereby to define the minimum width of the gap at the nip 16A between the rolls 16. As explained below herein, the roll biasing units 110 and 111 are actuable to move the roll supports 104 inwardly against these central adjustable stop means but to permit outward springing movement of one of the casting rolls 16 against preset biasing forces.

Each adjustable stop means 107 is in the form of, for example, a worm or screw driven jack having a body 108 fixed relative to the central vertical plane of the caster, and two ends 109 which can be moved upon actuation of the driven jack equally in opposite directions to permit expansion and contraction of the jack to adjust the width of the gap at the nip 16A, while maintaining equidistant spacing of the rolls 16 from the central vertical plane of the caster and, also, a substantially constant gap between the casting rolls 16, if desired.

The caster is provided with two pairs of roll biasing units 110 and 111 connected one pair to the supports 104 of each roll 16. The roll biasing units 110 at one side of the machine are constructed and operate in accordance with an embodiment of the present invention. These units are fitted with helical biasing springs 112 to provide biasing forces on the respective roll supports 104. The biasing units 111 at the other side of the machine incorporate hydraulic actuators 113. These actuators are operable to hold the respective roll supports 104 of one roll firmly against the central stops and the other roll is free to move laterally against the action of the biasing springs 112 of the biasing units 110 to bias the casting rolls toward each other. In accordance with an alternative embodiment of the present invention, the biasing force may be supplied by servo-controlled biasing using servo-mechanisms.

Figure 8:
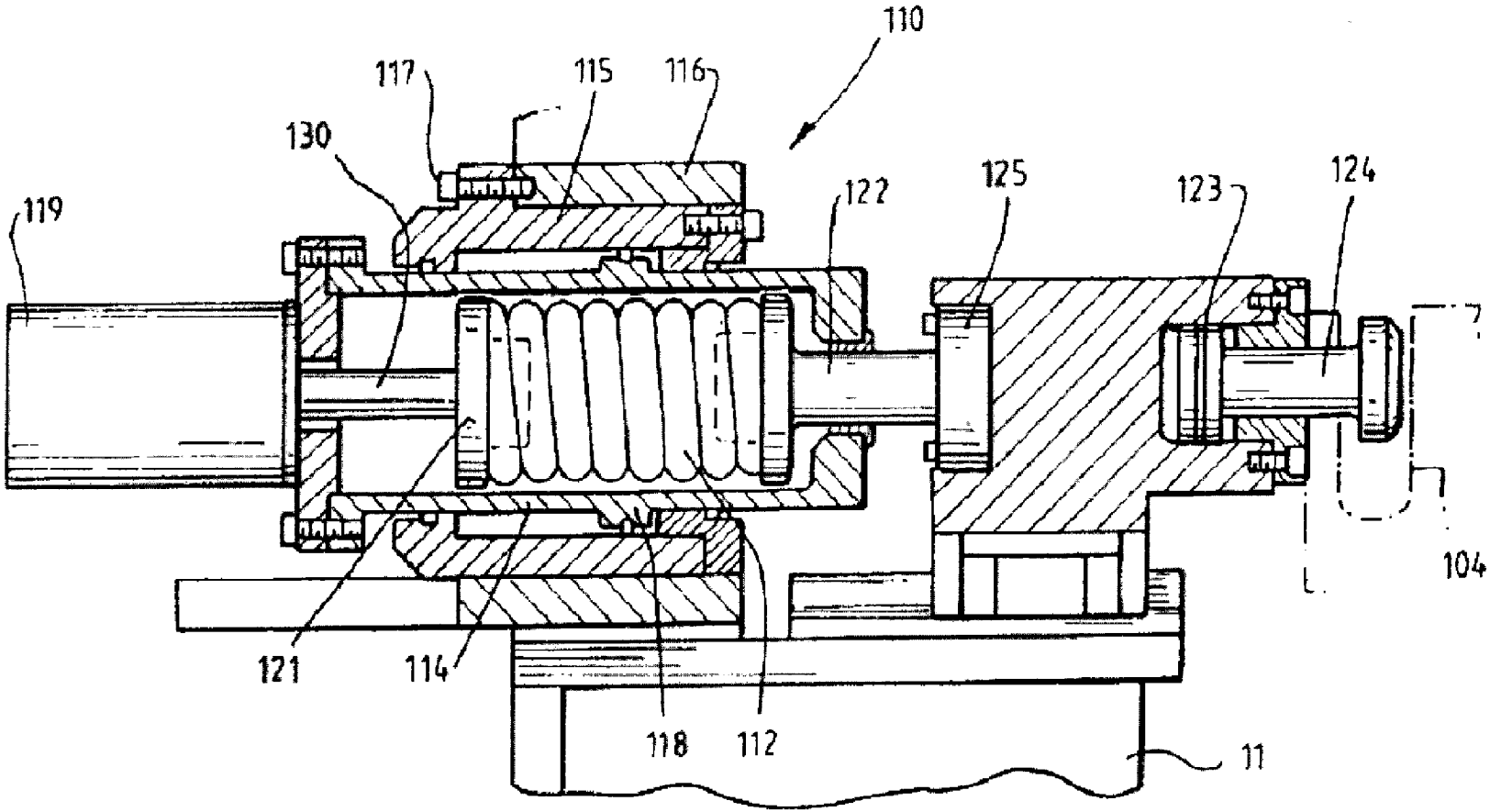
FIG. 8 is a vertical cross-section through a roll biasing unit incorporating a roll biasing spring.

The detailed construction of applicable biasing units 110 is illustrated in FIG. 8. As shown in FIG. 8, the biasing unit comprises a spring barrel housing 114 disposed within an outer housing 115 which is fixed to the main caster frame 116 by fixing bolts 117.

Spring housing 114 is formed with a piston 118 that runs within the outer housing 115. Spring housing 114 can be set alternatively in an extended position as illustrated in FIG. 8 and a retracted position by flow of hydraulic fluid to and from the cylinder 119. The outer end of the spring housing 114 carries a pressure fluid operable means in the form of a hydraulic cylinder unit 119 (positioning unit) operable to set the position of a spring reaction plunger 121 (thrust reaction structure) connected to the piston of unit 119 by a connecting rod 130.

The inner end of the spring 112 (thrust generator) acts on (exerts a force on) a thrust transmission structure 122 which is connected to the respective roll support 104 through a load cell 125. The thrust structure is initially pulled into firm engagement with the roll support by a connector 124 that can be extended by operation of a hydraulic cylinder 123 when the biasing unit is to be disconnected.

When biasing unit 110 is connected to its respective roll support 104, with the spring housing 114 set in its extended condition as shown in FIG. 8, the position of the spring housing 114 and cylinder unit 119 is fixed relative to the machine frame and the position of the spring reaction plunger 121 can be set to adjust the effective gap between the spring abutments on the reaction plunger and the thrust transmission structure 122. The compression of the spring 112 can thereby be adjusted to vary the thrusting force applied to the thrust transmission structure 122 and the respective roll support 104. With this arrangement, the only relative movement during casting operation is the movement of the roll support 104 and thruster structure 122 as a unit against the biasing spring. Since the biasing unit acts to bias the roll support 104 inwardly against the stop, it can be adjusted to preload the roll support with a certain spring biasing force before metal actually passes between the casting rolls, and that biasing force can be maintained, if desired, during a subsequent casting operation.

Hydraulic cylinder unit 119 is operated continuously to vary the position of the spring reaction plunger to replicate movements of the thrust transmission structure 122 due to lateral movements of the roll support 104. Any inward or outward movement of roll support 104 will cause a corresponding inward or outward movement of the cylinder of cylinder unit 119 and, therefore, of spring reaction plunger 121 so as to maintain a desired compression of the compression spring 112. Accordingly, a desired biasing force (e.g., to cause a desired roll separation force of between 2 and 4.5 Newtons per millimeter) may be maintained against the casting rolls 16 at each end of the roll regardless of movements of the roll mountings. The continuously operable spring setting means enables very accurate setting of biasing forces that can be maintained or accurately changed to other biasing force values throughout a casting operation. For example, a roll separation force in the range of between 2 and 4.5 Newtons per millimeter can allow for casting of thinner metal strip by allowing the shoulders of the side closure plates 56 (side dams) to be further ground in to the sides of the casting rolls. Moreover, it is possible to use very low stiffness springs, and because the two compensation or control systems for the two roll ends operate completely independently, there need be no cross-talk between the two. Accordingly, such an arrangement allows the roll biasing force to be accurately maintained to regulate roll separation forces to between about 2 and 4.5 Newtons per millimeter at the casting rolls 16.

Figure 9:
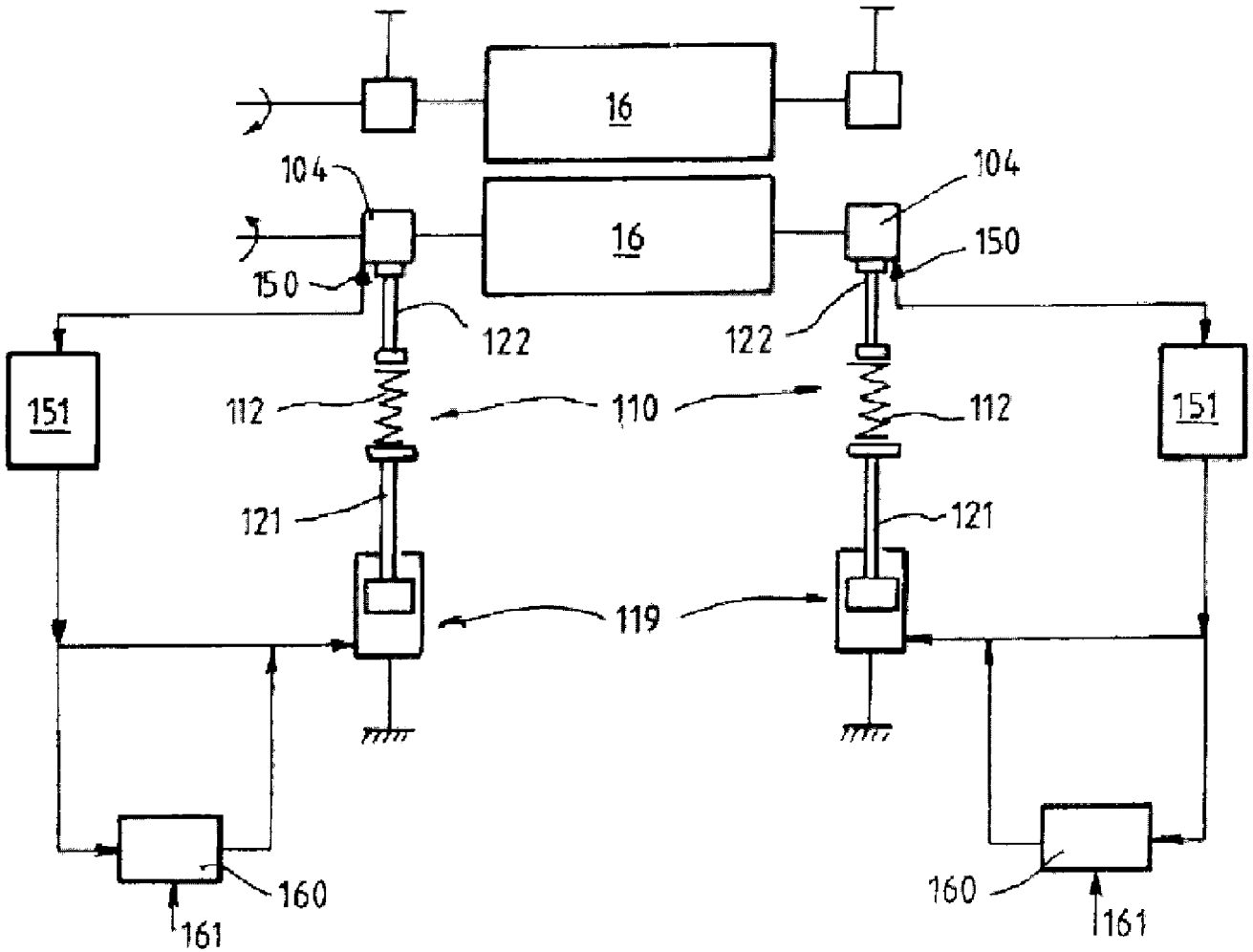
FIG. 9 is a schematic representation of various components of the caster, in accordance with an embodiment of the present invention.

As illustrated diagrammatically in FIG. 9, exemplary control means can be comprised of position sensors 150, sensing the position of the thrust transmission structures 122 and connected into a control circuit which controls the operation of the cylinder unit 119 so that the movements of the thrust transmission structures 122 are replicated by the cylinders of units 119. The control circuit may comprise controllers 151 connected to the sensors 150 and to the cylinder units 119 to operate the cylinders 119 so as to replicate movements of the thrust transmission structures 122. Controllers 151 also control operation of the cylinders for initial setting of the roll supports prior to casting and subsequent adjustment to add a similar incremental movement of the cylinders 119 through step controllers 160 to maintain a desired biasing force, and to change the gap at the nip 16A between the casting rolls 16. The step controllers have a set point input at 161.

Typically, in accordance with illustrated embodiments of the present invention, the system may be operated to adjust a gap at the nip 16A between the casting rolls 16 to compensate for various low, medium, or high frequency vibrations occurring within the system which can affect strip quality (i.e., create defects in the thin metal strip).

Figure 10:
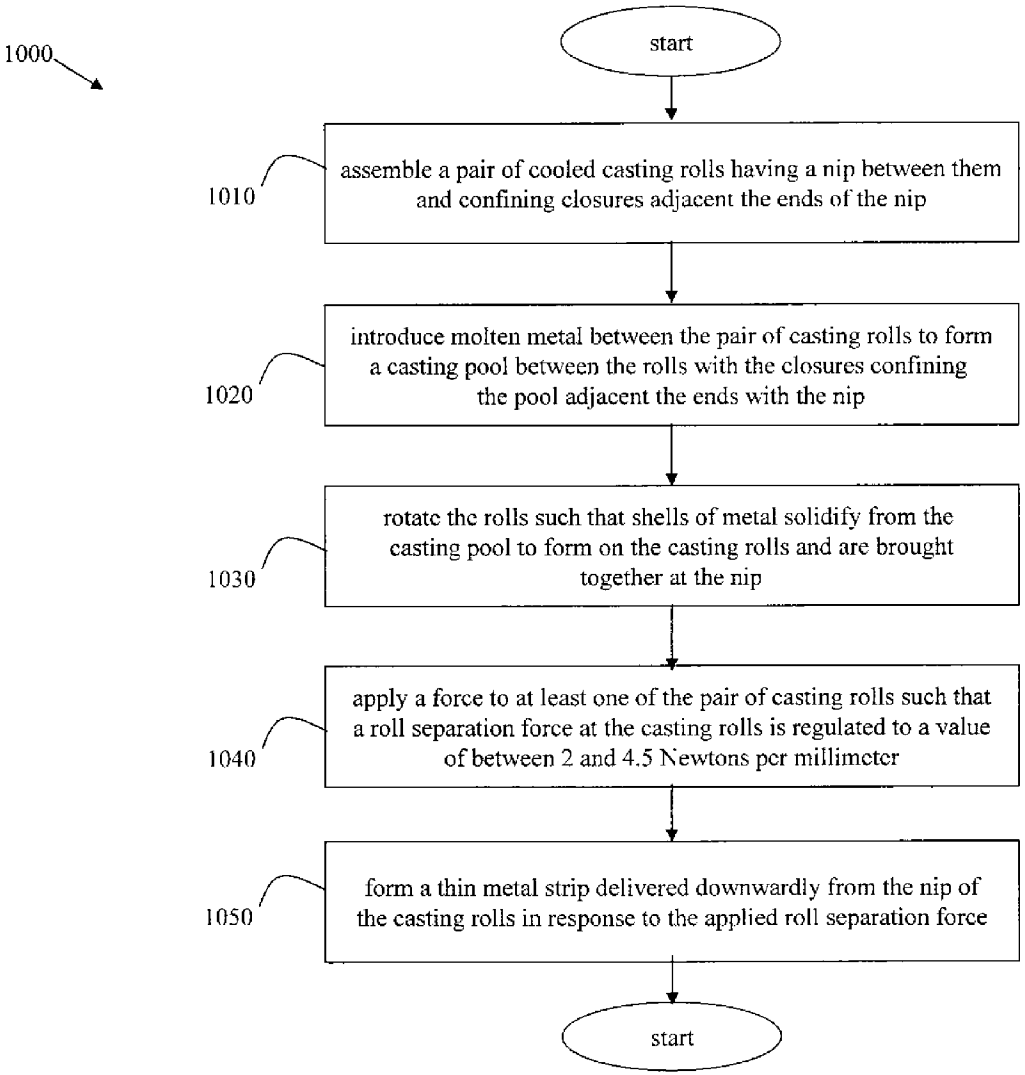
FIG. 10 is a flowchart of an embodiment of a method of casting thin cast strip, in accordance with various aspects of the present invention.

FIG. 10 is a flowchart of an embodiment of a method 1000 of casting thin cast strip, in accordance with various aspects of the present invention. In step 1010, a pair of cooled casting rolls are assembled having a nip between them and confining closures adjacent the ends of the nip. In step 1020, molten metal is introduced between the pair of casting rolls to form a casting pool between the rolls with the closures confining the pool adjacent the ends with the nip. In step 1030, the casting rolls are rotated such that shells of metal solidfy from the casting pool to form on the casting rolls and are brought together at the nip. In step 1040, a force is applied to at least one of the pair of casting rolls such that a roll separation force at the casting rolls is regulated to a value between about 2 and 4.5 Newtons per millimeter. In step 1050, thin metal strip is formed and delivered downwardly from the nip of the casting rolls in response to the applied roll separation force.

Figure 11:
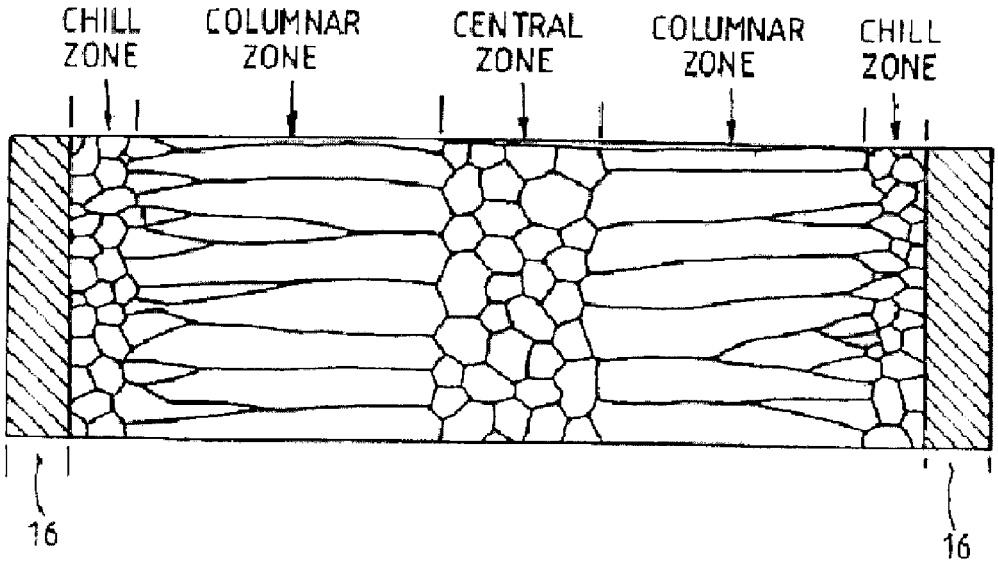
FIG. 11 is a cross-section of a cast steel strip made as described herein, in accordance with an embodiment of the present invention.

Referring to FIG. 11, unique steel product made by the presently described method is illustrated. The unique cast steel strip made by the following steps of assembling a pair of cooled casting rolls having a nip between them and confining closures adjacent the ends of the nip, introducing molten metal between the pair of casting rolls to form a casting pool between the rolls with the closures confining the pool adjacent the ends of the nip, rotating the rolls such that shells of metal solidify from the casting pool onto the casting rolls and are brought close together at the nip, applying a force to at least one of the pair of casting rolls such that the roll separation force at the casting rolls is regulated to a value between 2 and 4.5 Newtons per millimeter, and forming thin metal strip delivered downwardly from the nip of the casting rolls.

The columnar dendrite structure of steel formed in the solidified shells onto the casting rolls 16 do not come together. This is illustrated by comparison in FIG. 12, where the structure of steel strip made by the previously described strip casting process is illustrated. There, the columnar dendrite structure of the solidified shells join in the formed strip as the solidified shells come together. However, in steel strip made in accordance with embodiments of the present invention, there is a central zone within the steel strip between the solidified shells that solidifies after strip passes through the gap between the casting rolls 16 at the nip 16A. Also, defects in the steel strip may be reduced if not completely eliminated by allowing control of the variation of the roll separation force between about 2 and 4.5 Newtons per millimeter.

Figure 12:
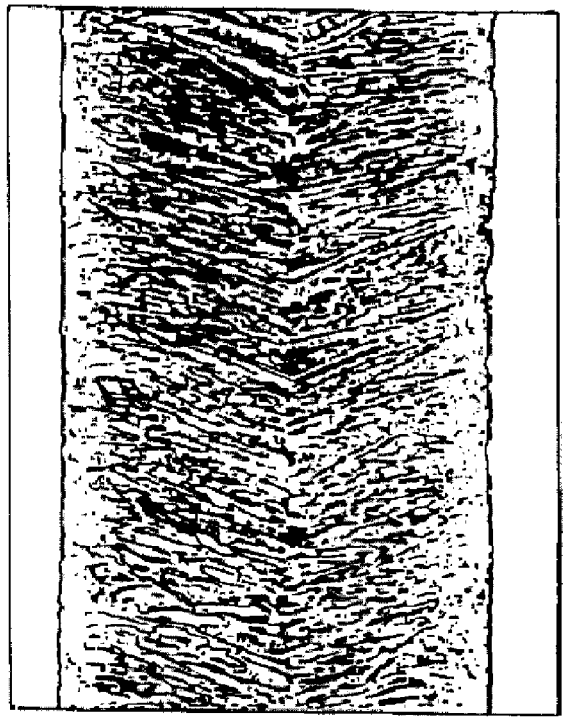
FIG. 12 is a cross-section of a cast steel strip of the prior art illustrated for purposes of comparison.

In accordance with an alternative embodiment of the present invention, the system may be operated to maintain a gap at the nip 16A between the casting rolls 16 which is greater than the gap determined by the solidified shell thickness. In operation, casting commences with a gap initially determined by the solidified shell thickness. This thickness is illustrated in FIG. 12 where the dendrites of the solidified shells of the strip join in the formed strip. Movement of the roll supports due to remaining roll eccentricities are sensed by the sensors 150 and the control unit learns the pattern of roll movements due to that eccentricity. In order to compensate for the eccentricity induced force fluctuation, the roll chock trajectories are replicated at the spring (thrust) reaction structures by the position control system and those compensatory movements are continued. The roll gap is then increased by a small amount (such as, for example, 0 to 50 microns) while the pattern of movements of the spring reaction structure is continued. This even further enhances the already formed gap between the casting rolls by further reducing, if not eliminating, force fluctuation induced by roll eccentricity.

In the control system of FIG. 9, the step of increasing the gap at the nip 16A is achieved by moving the roll carriers supporting the spring biased roll and the hydraulically actuated biasing units (carrier drive units) for the other roll are operated to lock the other roll in a fixed position. The system, in accordance with an embodiment of the present invention, can be used in combination with the eccentricity control system described in U.S. patent application Ser. No. 10/104,313, which description now is incorporated herein by reference. In that system, the thickness variations due to roll eccentricity can be very much reduced by imposing a pattern of speed variation in the speed of rotation of the casting rolls. Compensation in this manner is possible because even small variations vary the time of contact of the solidifying metal shells on the casting rolls within the casting pool, and therefore affect the strip thickness and roll thermal load to facilitate the production of strip of constant thickness.

In accordance with an embodiment of the present invention, the thickness of the cast metal strip may be reduced during a casting campaign. For example, a casting campaign may start by casting steel strip having a thickness of about 1.8 millimeters. The side dam shoulders have been ground in to allow for such a thickness. Halfway through the casting campaign, it may be desirable to change to casting strip having a thickness of 1.5 millimeters. By providing roll separation forces in the range of between 2 and 4.5 Newtons per millimeter, the gap between the casting rolls can be reduced by allowing the shoulders of the side dams to be further ground into the sides of the casting rolls, in a controlled manner, to achieve the 1.5 millimeter thickness.

In summary, as described herein, an apparatus for continuously casting metal strip comprises a pair of cooled casting rolls forming a nip therebetween; a metal supply system to deliver molten metal into the nip between the rolls to form a casting pool of molten metal supported on casting roll surfaces above the nip; a pair of closure plates to confine the molten metal in the casting pool against outflow adjacent the ends of the nip; a roll drive mechanism to drive the casting rolls in counter-rotational directions to produce a solidified strip of metal delivered downwardly from the nip; at least one of the casting rolls mounted on a pair of moveable roll carriers that allow that roll to move toward and away from the other roll; a pair of carrier drive units acting one on each of the pair of moveable roll carriers to bias said one roll toward the other roll; and a control system to control operation and capable of positioning of the carrier drive units so as to provide a roll separation force at the casting rolls that is regulated to a value of between 2 and 4.5 Newtons per millimeter during a casting operation.

In conclusion, certain embodiments of the present invention provide a system and method for casting thin cast strip by applying a force to at least one of a pair of casting rolls of a casting system such that a roll separation force at the casting rolls is regulated to a value of between about 2 and 4.5 Newtons per millimeter. Such regulation allows for better control of the casting process resulting in reduced defects in the resultant thin cast metal strip.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A method of casting metal strip comprising:

assembling a pair of cooled casting rolls having a nip between them and confining closures adjacent the ends of the nip;

introducing molten steel between said pair of casting rolls to form a casting pool between the rolls with the closures confining the pool adjacent the ends with the nip;

rotating the rolls such that shells of metal solidify from the casting pool to form on the casting rolls and are brought together at the nip;

applying a force to at least one of the pair of casting rolls such that a roll separation force at the casting rolls is regulated to a value between 2 and 4.5 Newtons per millimeter; and forming a thin metal strip delivered downwardly from the nip of the casting rolls in response to the applied roll separation force.

2. The method of claim 1 wherein the casting rolls are rotated to produce said thin metal strip at a casting speed of at least 30 meters/minute.

3. The method of claim 1 wherein the casting rolls are rotated to produce said thin metal strip at a casting speed of at least 60 meters/minute.

4. The method of claim 1 wherein said applied force is applied by spring biasing.

5. The method of claim 1 wherein said applied force is applied by servo-controlled biasing.

6. The method of claim 1 further comprising additional steps of mounting at least one of the casting rolls on a moveable roll support to provide movement of the casting rolls toward each other, and applying said applied force to the roll supports by a pair of biasing units.

7. The method of claim 6 further comprising additional steps of including in the biasing units a thrust generator acting between a thrust transmission structure connected to the roll supports, and including a thrust reaction structure generating a thrust on the roll support dependent on the spacing between the thrust reaction structure and the thrust transmission structure.

8. The method of claim 7 wherein the thrust generator includes a compression spring or pressure fluid cylinder unit.

* * * * *